US010476175B2

(12) United States Patent
Idota et al.

(10) Patent No.: US 10,476,175 B2
(45) Date of Patent: Nov. 12, 2019

(54) TERMINAL-EQUIPPED ELECTRIC WIRE, AND TERMINAL

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Tomoki Idota, Mie (JP); Hitoshi Takeda, Mie (JP); Hiroshi Shimizu, Mie (JP)

(73) Assignees: AutoNetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 16/097,940

(22) PCT Filed: Apr. 19, 2017

(86) PCT No.: PCT/JP2017/015665
§ 371 (c)(1),
(2) Date: Oct. 31, 2018

(87) PCT Pub. No.: WO2017/195547
PCT Pub. Date: Nov. 16, 2017

(65) Prior Publication Data

US 2019/0148843 A1 May 16, 2019

(30) Foreign Application Priority Data

May 10, 2016 (JP) ..... 2016-094438

(51) Int. Cl.
*H01R 4/18* (2006.01)
*H01R 4/02* (2006.01)
*H01R 43/02* (2006.01)

(52) U.S. Cl.
CPC ..... *H01R 4/02* (2013.01); *H01R 4/023* (2013.01); *H01R 4/029* (2013.01); *H01R 4/18* (2013.01);
(Continued)

(58) Field of Classification Search
CPC ..... H01R 4/185; H01R 4/187; H01R 4/023
See application file for complete search history.

(56) References Cited

U.S. PATENT DOCUMENTS

| | | | | |
|---|---|---|---|---|
| 7,581,966 B2 * | 9/2009 | Shigehisa | ..... | H01R 4/185 439/98 |
| 8,870,610 B2 * | 10/2014 | Tsuji | ..... | H01R 4/029 439/874 |
| 2013/0244511 A1 * | 9/2013 | Van Tilburg | ..... | H01R 4/10 439/877 |

FOREIGN PATENT DOCUMENTS

| | | |
|---|---|---|
| JP | 09-092348 A | 4/1997 |
| JP | 4966130 B | 4/2012 |
| JP | 2014-107104 A | 6/2014 |

OTHER PUBLICATIONS

International Search Report dated Jul. 4, 2017 for WO 2017/195547 A1.

* cited by examiner

*Primary Examiner* — Tho D Ta
(74) *Attorney, Agent, or Firm* — Abelman, Frayne & Schwab

(57) ABSTRACT

A terminal-equipped electric wire includes: an electric wire including a core wire and an insulating coating; and a terminal connected to the core wire exposed from an end portion of the electric wire. The terminal includes: a flat-plate-shaped weld portion; a bottom plate portion; and a crimping piece. In a state where the crimping piece is crimped so as to be wound around an outer periphery of the
(Continued)

insulating coating, a leading edge of the crimping piece is located on a bottom plate portion side with respect to a first virtual plane that passes through the center of the electric wire and is perpendicular to the bottom plate portion, and the leading edge of the crimping piece is in proximity to a side edge of the bottom plate portion on a side opposite to a side on which the crimping piece is provided.

9 Claims, 13 Drawing Sheets

(52) U.S. Cl.
CPC ..... *H01R 43/0207* (2013.01); *H01R 43/0249* (2013.01); *H01R 4/185* (2013.01); *H01R 4/187* (2013.01)

TERMINAL-EQUIPPED ELECTRIC WIRE, AND TERMINAL

CROSS REFERENCE TO RELATED APPLICATIONS

This application is a national phase of PCT application No. PCT/JP2017/015665, filed on 19 Apr. 2017, which claims priority from Japanese Patent Application No. 2016-094438, filed on 10 May 2016, all of which are incorporated herein by reference.

TECHNICAL FIELD

The present invention relates to a terminal-equipped electric wire and a terminal.

BACKGROUND

Generally, a terminal is composed of a portion to be connected electrically to a core wire of an electric wire when it is connected to an end of the electric wire and a portion for holding a portion of the core wire covered with a coating. The portion for holding the portion of the core wire covered with a coating is designed so that it plays a role of reducing the impact of a force applied to the electric wire on the connected portion with the core wire and it is less likely to damage the insulation coating of the electric wire. For example, a conventional terminal disclosed in JP 2013-4406 A includes a portion to which a core wire is to be welded and an insulation barrel to be crimped so as to wrap around the outer periphery of an insulating coating from both sides. The insulation barrel is provided with a redundant portion such that the entire length of the insulation barrel is longer than the outer periphery of the electric wire, and a force applied to the insulation coating is adjusted by providing the redundant portion. The insulation barrel thus configured is less likely to damage the insulating coating while ensuring a holding force to the electric wire.

PRIOR ART DOCUMENT

Patent Document

Patent Document 1: JP 2013-004406 A

SUMMARY OF THE INVENTION

Problem to be Solved

However, in the conventional terminal described in JP 2013-4406 A (Patent Document 1), the insulation barrel extends from both sides of the terminal in a direction (width direction) orthogonal to the axial direction of the terminal. Thus, a large dimension (non-crimped length) in the width direction is required when punching out the terminal from a plate material. Accordingly, depending on the shape of the terminal, the non-crimped length of the insulation barrel may be a maximum non-crimped length. That is, the non-crimped length of the insulation barrel extending from both sides is a factor reducing the yield of the terminal, i.e., a factor increasing cost.

Means to Solve the Problem

The terminal-equipped electric wire disclosed herein is a terminal-equipped electric wire including an electric wire with a core wire whose outer periphery is surrounded by an insulating coating, a terminal being connected to the core wire exposed from an end portion of the electric wire. The terminal includes: a flat-plate-shaped weld portion to which the core wire is welded; a bottom plate portion that is continuous with the weld portion and on which the insulating coating of the electric wire is placed; and a crimping piece extending from one side edge of the bottom plate portion in a direction intersecting with a direction in which the electric wire placed on the bottom plate portion extends. In a state where the crimping piece is crimped so as to be wound around an outer periphery of the insulating coating of the electric wire, a leading edge of the crimping piece is located on a bottom plate portion side with respect to a first virtual plane that passes through a center of the electric wire and is perpendicular to the bottom plate portion, and the leading edge of the crimping piece is in proximity to a side edge of the bottom plate portion on a side opposite to a side on which the crimping piece is provided.

According to such a configuration, the crimping piece crimped so as to be wound around the insulating coating of the electric wire is provided so as to extend from one side edge of the bottom plate portion. Thus, the non-crimped length of the crimping piece may be shorter than that in the case where the crimping piece extends from both side edges of the bottom plate portion. Furthermore, the outer periphery of the insulating coating is wrapped to the extent that the leading edge of the crimping piece is located on the bottom plate portion side with respect to the first virtual plane that passes through the center of the electric wire and is perpendicular to the bottom plate portion, and the leading edge of the crimping piece is in proximity to the side edge of the bottom plate portion on the opposite side. That is, the bottom plate portion and the crimping piece are wound around at least half of the outer periphery of the electric wire, and therefore a holding force to the electric wire can be ensured.

As embodiments of the terminal-equipped electric wire disclosed herein, the following configurations may be adopted.

The terminal-equipped electric wire may be configured such that in the state where the crimping piece is crimped so as to be wound around the outer periphery of the insulating coating of the electric wire, the leading edge of the crimping piece is located on the bottom plate portion side with respect to a second virtual plane that passes through the center of the electric wire and is parallel to the bottom plate portion, and the leading edge of the crimping piece is in proximity to the side edge of the bottom plate portion on the side opposite to the side on which the crimping piece is provided.

According to such a configuration, the outer periphery of the insulating coating is wrapped to the extent that the leading edge of the crimping piece is located on the bottom plate portion side with respect to the virtual plane that passes through the center of the electric wire and is parallel to the bottom plate portion, and the leading edge of the crimping piece is in proximity to the side edge of the bottom plate portion on the opposite side. That is, the bottom plate portion and the crimping piece are wound around at least three quarters of the outer periphery of the electric wire, and therefore a holding force to the electric wire can be ensured even more reliably.

The terminal-equipped electric wire may be configured such that in a state where the electric wire is crimped by the crimping piece, an end face of the crimping piece abuts against the bottom plate portion.

According to such a configuration, the crimping piece covering the outer periphery of the electric wire abuts against the bottom plate portion, and therefore the holding force to the electric wire can be improved. Furthermore, since only the crimping piece extends from the bottom plate portion, the non-crimped length can be shortened.

The terminal-equipped electric wire may be configured such that an auxiliary piece that extends in a direction intersecting with the direction in which the electric wire placed on the bottom plate portion extends and is shorter than the crimping piece is provided on the side edge of the bottom plate portion on the side opposite to the side on which the crimping piece is provided, and in a state where the electric wire is crimped by the crimping piece, an end portion of the crimping piece and an end portion of the auxiliary piece overlap each other.

According to such a configuration, the end portion of the crimping piece overlaps the end portion of the auxiliary piece, and therefore the holding force can be improved. Furthermore, since the crimping piece and the auxiliary piece extend from both sides of the bottom plate portion, positioning of the electric wire can be achieved at the time of placing the electric wire on the bottom plate portion. On the other hand, the auxiliary piece is shorter than the crimping piece. Thus, as compared with the case where a crimping piece extends evenly from both side edges as in the prior art, the non-crimped length can be shortened.

The terminal-equipped electric wire may be configured such that an end face of the weld portion and an end face of the bottom plate portion are flush with each other in a flat, non-crimped state.

According to such a configuration, since the end face of the weld portion and the end face of the bottom plate portion are flush with each other, their positions on at least one side in the width direction are aligned with each other. This allows the yield to be improved.

The terminal-equipped electric wire may be configured such that an end face of the weld portion and an end face of the auxiliary piece are flush with each other in a flat, non-crimped state.

According to such a configuration, since the end face of the weld portion and the end face of the auxiliary piece are flush with each other, positions on at least one side in the width direction are aligned with each other. This allows the yield to be improved.

The terminal disclosed herein is a terminal including: a flat-plate-shaped weld portion to which a core wire of an electric wire is to be welded; a bottom plate portion that is continuous with the weld portion and on which a portion surrounded by an insulating coating in the electric wire is to be placed; and a crimping piece extending from one side edge of the bottom plate portion in a direction intersecting with a direction in which the electric wire placed on the bottom plate portion extends. In a state where the crimping piece is crimped so as to be wound around an outer periphery of the electric wire, a leading edge of the crimping piece extends in a direction different from the direction orthogonal to the weld portion, and is in proximity to a side edge of the bottom plate portion on a side opposite to a side on which the crimping piece is provided.

As embodiments of the terminal disclosed herein, the following configurations may be adopted.

The terminal may be configured such that in a state where the electric wire is crimped by the crimping piece, an end face of the crimping piece abuts against the bottom plate portion.

The terminal may be configured such that an auxiliary piece that extends in a direction intersecting with the direction in which the electric wire placed on the bottom plate portion extends and is shorter than the crimping piece is provided on the side edge of the bottom plate portion on the side opposite to the side on which the crimping piece is provided, and in a state where the electric wire is crimped by the crimping piece, an end portion of the crimping piece and an end portion of the auxiliary piece overlap each other.

The terminal may be configured such that an end face of the weld portion and an end face of the bottom plate portion are flush with each other in a flat, non-crimped state.

The terminal may be configured such that an end face of the weld portion and an end face of the auxiliary piece are flush with each other in a flat, non-crimped state.

EFFECT OF THE INVENTION

According to the terminal-equipped electric wire and the terminal disclosed herein, it is possible to shorten the non-crimped length of a portion of the terminal to be crimped to an electric wire.

DETAILED DESCRIPTION TO EXECUTE THE INVENTION

First Embodiment

The first embodiment will be described with reference to FIGS. 1 to 7.

Figure 1:
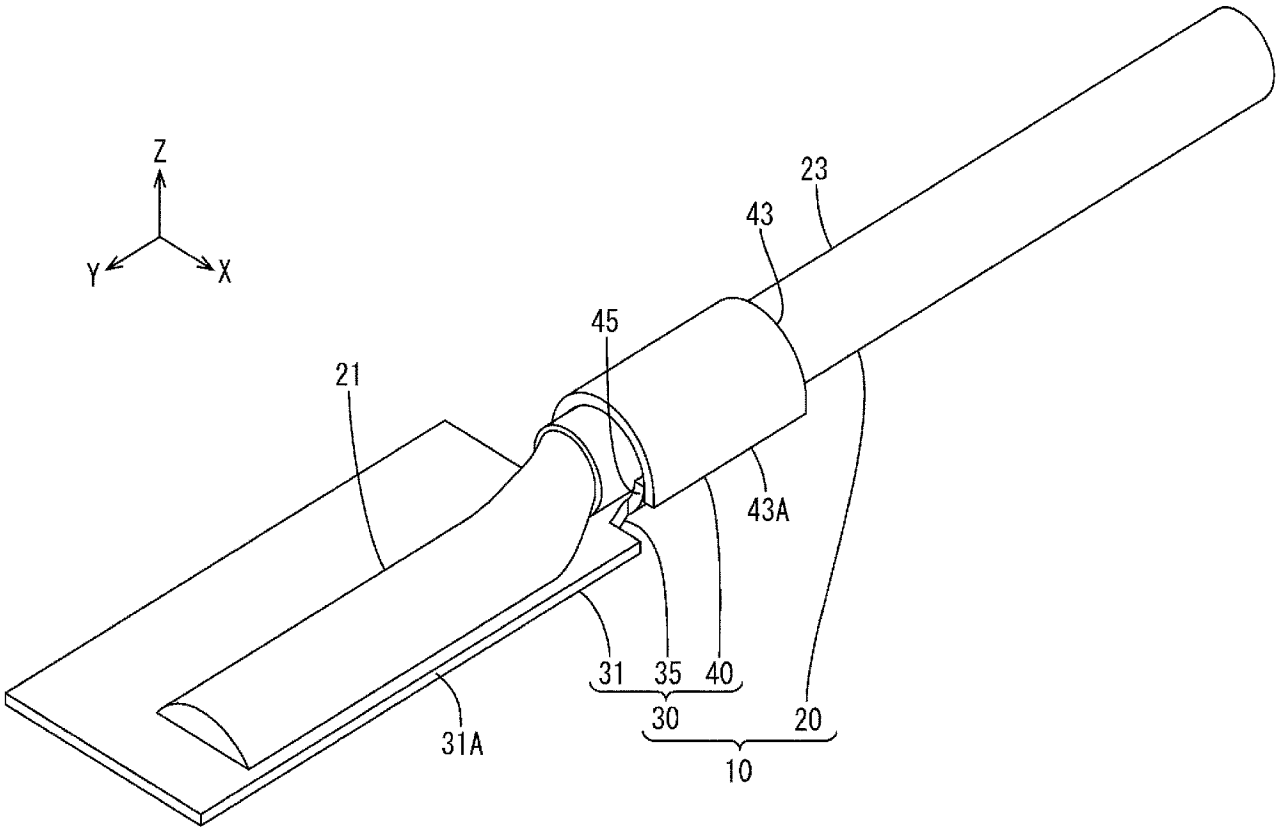
FIG. 1 is a perspective view of a terminal-equipped electric wire according to a first embodiment.
Figure 2:
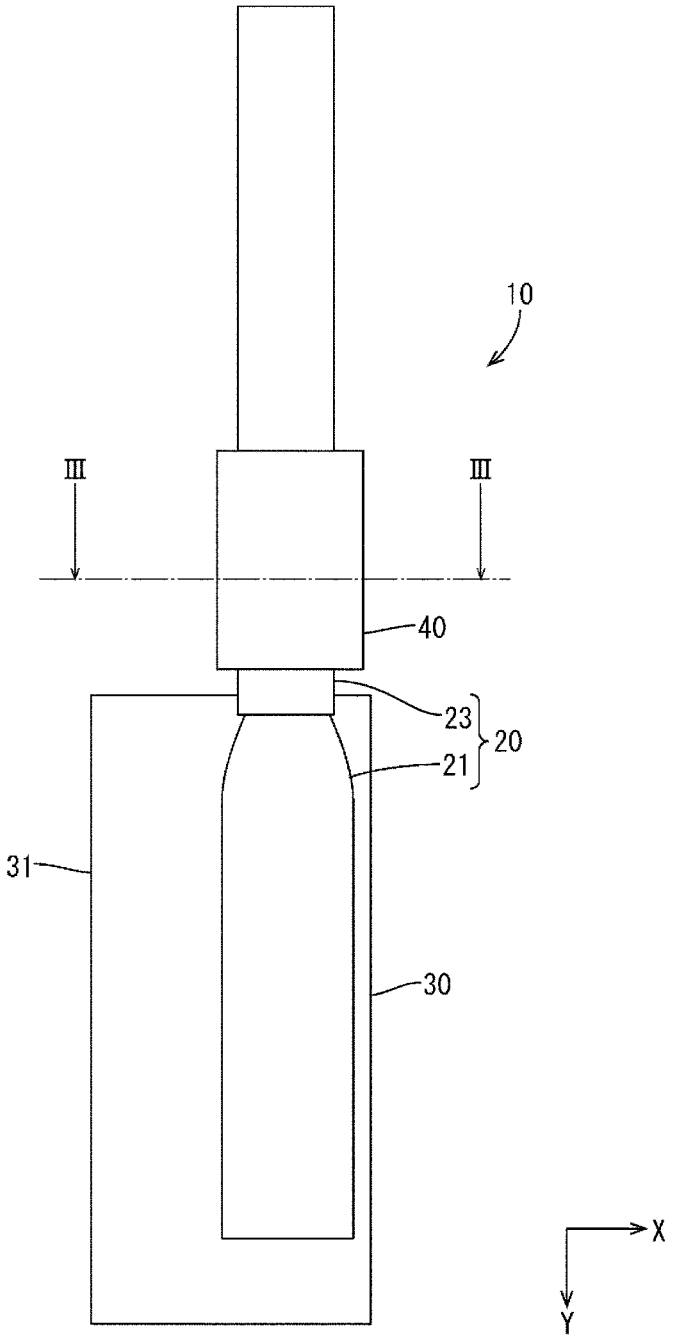
FIG. 2 is a plan view of the terminal-equipped electric wire.

As shown in FIGS. 1 and 2, a terminal-equipped electric wire 10 of the present embodiment includes an electric wire 20 and a terminal 30 connected to an end of this electric wire 20. In the following description, the Z direction indicates an upward direction in a vertical direction, the X direction indicates a right direction in a left-right direction, and the Y direction indicates a forward direction in a front-rear direction.

As shown in FIG. 2, the electric wire 20 is configured such that the outer periphery of a core wire 21 formed of electrically conductive metal strands is surrounded by an insulation coating 23. The electric wire 20 is a wire called a "fine wire" for use as a signal wire or the like, and has a small outer diameter. The insulating coating 23 is stripped from a front end portion of the electric wire 20 to expose the core wire 21. Then, the electric wire 20 is placed on the terminal 30 so as to extend in the front-rear direction.

The terminal 30 is formed by pressing and then bending an electrically conductive metal plate material. As shown in FIG. 1, the terminal 30 includes a weld portion 31 to which the core wire 21 of the electric wire 20 is to be welded, a crimping portion 40 to be crimped to the electric wire 20, and a neck portion 35 connecting the weld portion 31 and the crimping portion 40.

As shown in FIGS. 1 and 2, the weld portion 31 has a rectangular shape in a plan view, and the dimension of the weld portion 31 in the front-rear direction is longer than the dimension thereof in the width direction. The exposed core wire 21 is welded to the right half of the weld portion 31 in the left-right direction (width direction). That is, the core wire 21 is welded at a position biased to one side in the width direction of the weld portion 31.

As shown in FIG. 1, the neck portion 35 is formed so as to extend rearward from the rear end of the weld portion 31. The right end position of the neck portion 35 is located to the left of a right end face 31A of the weld portion 31. That is, the neck portion 35 is provided more inward toward the center side (inside) in the width direction than the weld portion 31. The left end position of the neck portion 35 is located to the right of the central position of the weld portion 31 in the width direction. That is, the neck portion 35 extends rearward from a position biased to one side (right side) in the weld portion 31. The dimension of the neck portion 35 in the width direction is substantially the same as or slightly smaller than the maximum outer diameter of the electric wire 20.

Figure 7:
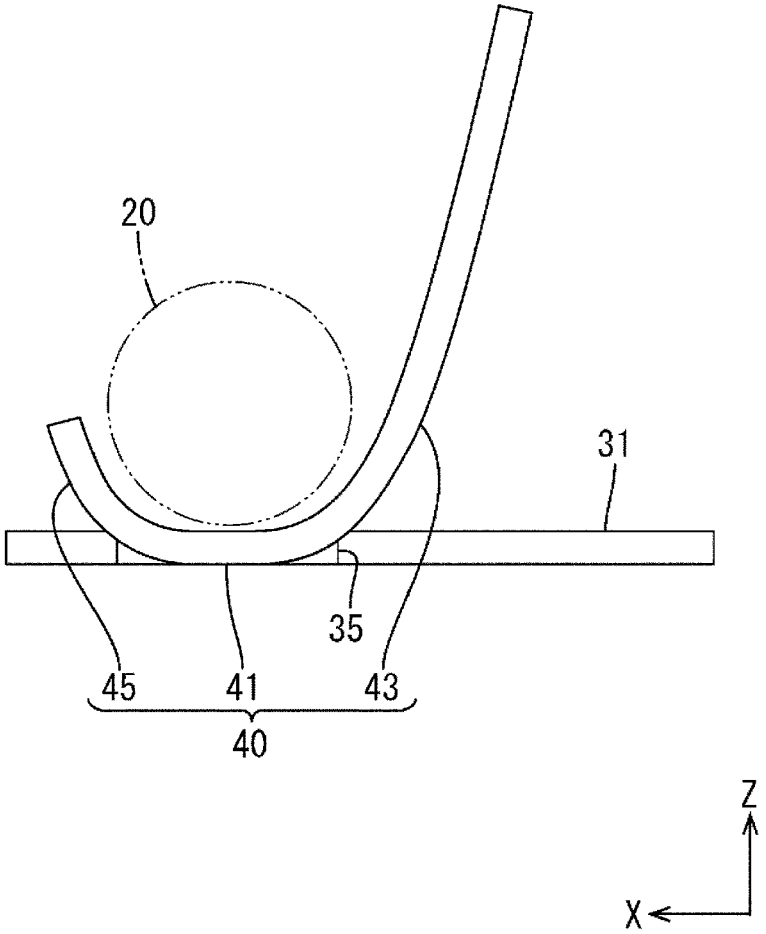
FIG. 7 is a rear view showing a state before crimping a crimping piece.

As shown in FIGS. 1 and 7, the crimping portion 40 includes a bottom plate portion 41, a crimping piece 43, and an auxiliary piece 45. The bottom plate portion 41 is continuous with the weld portion 31 via the neck portion 35, and the insulating coating 23 of the electric wire 20 is placed on the bottom plate portion 41. The dimension of the bottom plate portion 41 in the width direction is smaller than the dimension of the neck portion 35 in the width direction. Thus, in order to cause the rear end portion of the neck portion 35 to have the same width as the bottom plate portion 41, both the side end portions thereof are bent slightly so as to be continuous with the crimping piece 43 and the auxiliary piece 45.

Figure 3:
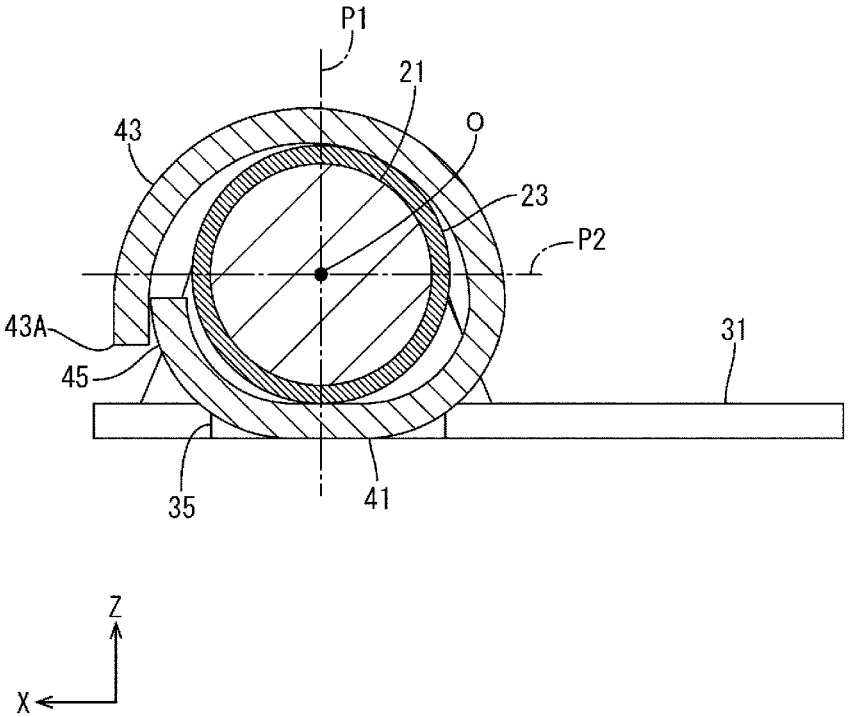
FIG. 3 is a sectional view taken along of FIG. 2.
Figure 4:
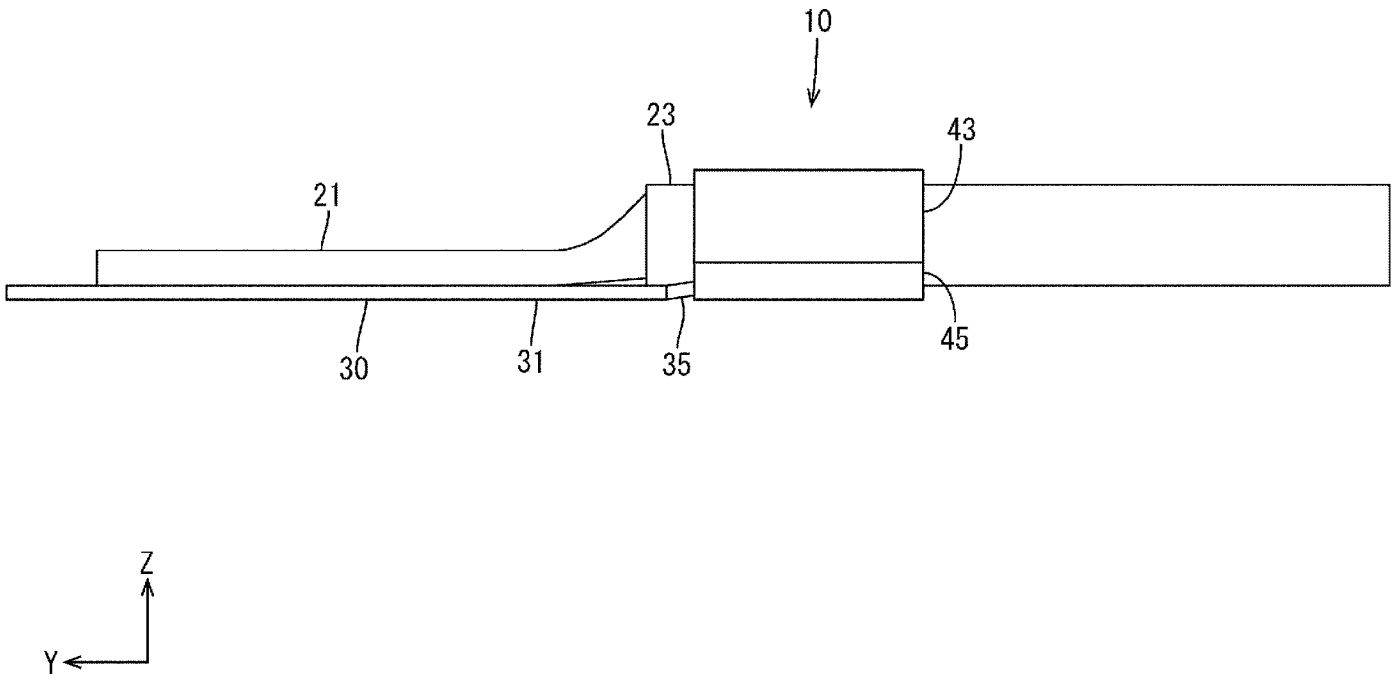
FIG. 4 is a right side view of the terminal-equipped electric wire.
Figure 5:
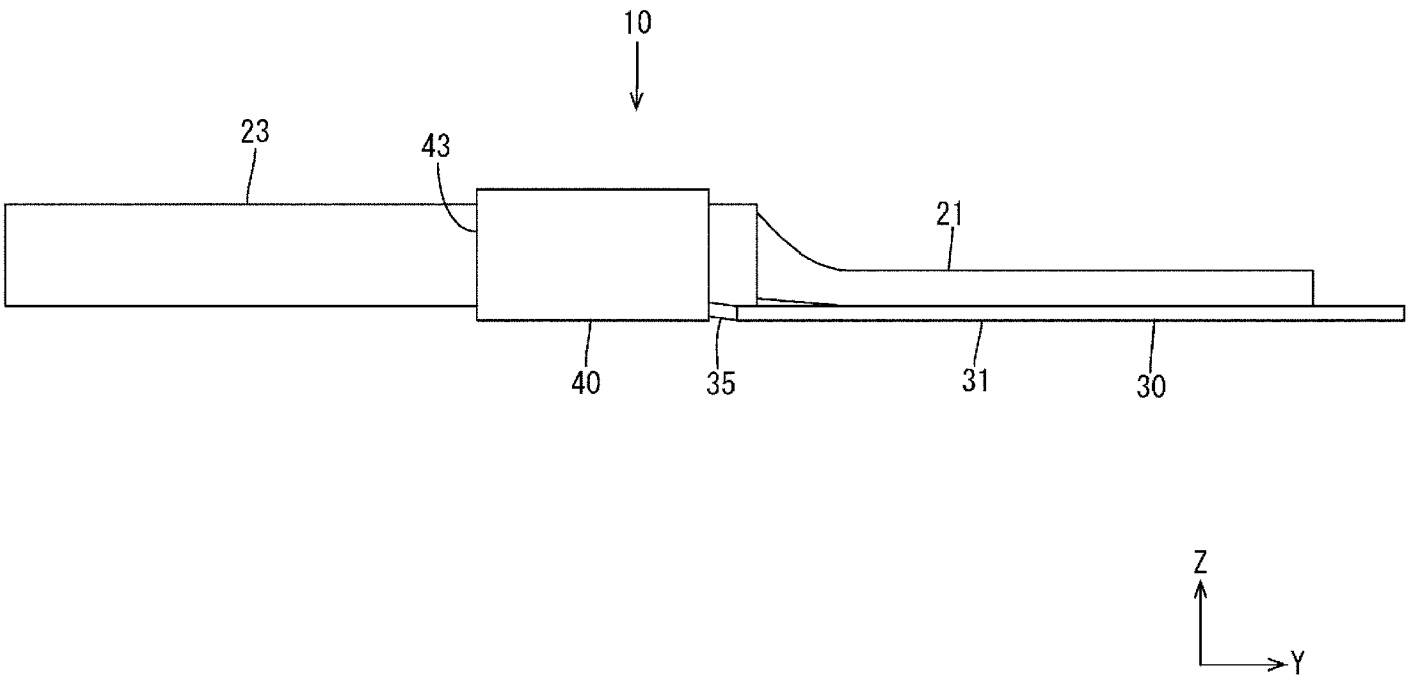
FIG. 5 is a left side view of the terminal-equipped electric wire.
Figure 6:
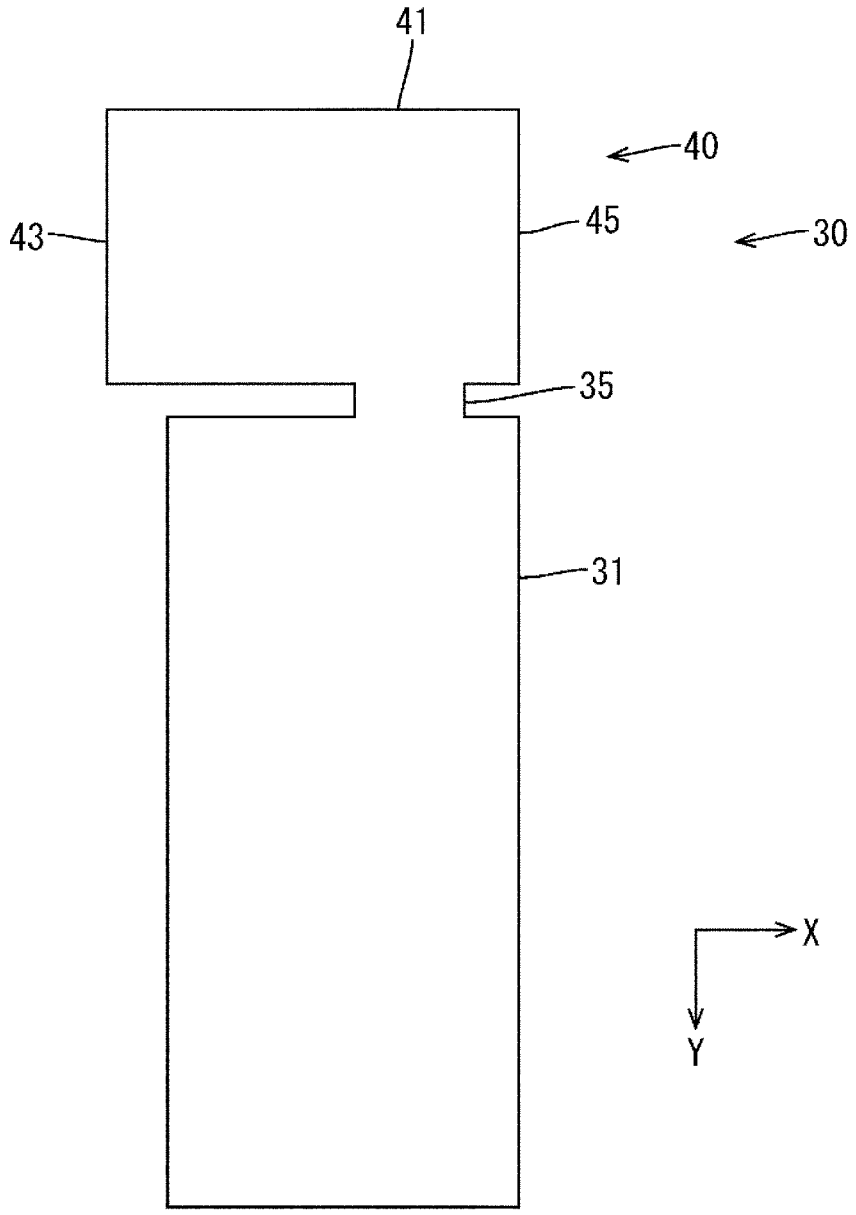
FIG. 6 is a plan view showing a non-crimped state of the terminal.

As shown in FIG. 7, the crimping piece 43 is provided so as to extend from one side edge (left side edge) of the bottom plate portion 41 in a direction intersecting with the direction in which the electric wire 20 extends (the front-rear direction). As shown in FIG. 3, this crimping piece 43 is crimped so as to be wound around the outer periphery of the insulating coating 23 of the electric wire 20. The width of the crimping piece 43 is such that the crimping piece 43 is wound around about three quarters of the outer periphery of the electric wire 20. Furthermore, as shown in FIG. 6, the left end position of the crimping piece 43 before being subjected to bending (non-crimped state) protrudes slightly to the left of the left end position of the weld portion 31.

As shown in FIGS. 1 and 7, the auxiliary piece 45 is provided such that, from a side edge of the bottom plate portion 41 on a side (right side) opposite to a side on which the crimping piece 43 is provided, the auxiliary piece 45 extends in a direction intersecting with a direction (front-rear direction) in which the electric wire 20 extends. Specifically, the auxiliary piece 45 is crimped in such a manner that it extends inward with respect to the crimping piece 43 while being wound around the outer periphery of the insulating coating 23 of the electric wire 20. The width of the auxiliary piece 45 is shorter than a width according to which the auxiliary piece 45 is wound around about one quarter of the outer periphery of the electric wire 20. As shown in FIGS. 6 and 7, the auxiliary piece 45 is provided to the right of the neck portion 35. In the non-crimped state, the width of the auxiliary piece 45 corresponds to the sum of the dimension by which the neck portion 35 is shifted to the left relative to the weld portion 31 and the dimension by which the bottom plate portion 41 is smaller than the neck portion 35. Furthermore, in the non-crimped state, a right end face 45A of the auxiliary piece 45 is flush with the right end face 31A of the weld portion 31.

As shown in FIG. 3, the state where the crimping portion 40 is wound around the outer periphery of the electric wire 20 will be described. In the following description, a virtual plane that passes through a center O in the radial direction of the electric wire 20 and is perpendicular to the bottom plate portion 41 is defined as a first virtual plane P1, and a virtual plane that passes through the center O in the radial direction of the electric wire 20 and is parallel to the bottom plate portion 41 is defined as a second virtual plane P2. In the state where the crimping portion 40 is wound around the outer periphery of the electric wire 20, a leading edge 43A of the crimping piece 43 passes over the first virtual plane P1 to be located below the second virtual plane P2 (on the bottom plate portion 41 side), and is in proximity to a side edge of the bottom plate portion 41 on a side (right side) opposite to a side on which the crimping piece 43 is provided. On the other hand, a leading edge (the right end face 45A) of the auxiliary piece 45 is located below the second virtual plane P2 and is interposed on the left side (electric wire 20 side) of the crimping piece 43. That is, the end portion of the crimping piece 43 overlaps the end portion of the auxiliary piece 45, and the position where they overlap each other is below the second virtual plane P2.

The configurations of the terminal-equipped electric wire 10 and the terminal 30 of the present embodiment are as described above. Next, methods of assembling the terminal-equipped electric wire 10 and the terminal 30 and functions of the terminal-equipped electric wire 10 and the terminal 30 will be described.

First, the insulating coating 23 at an end portion of the electric wire 20 is stripped. At this time, the core wire 21 is exposed to the extent that the exposed core wire 21 is slightly shorter than the dimension of the weld portion 31 in the front-rear direction.

On the other hand, an electrically conductive metal plate material is subjected to pressing to punch out the terminal 30 as shown in FIG. 6. At this time, the leading edge 43A (left end position) of the crimping piece 43 protrudes to the left of the left end position of the weld portion 31. However, the dimension of the protrusion (the dimension in the width direction) is smaller than that in a terminal provided with a crimping piece extending with the same length from both sides of a bottom plate portion. That is, as compared with the case where the crimping piece extends evenly from both side edges of the bottom plate portion, the non-crimped length (the dimension in the width direction) of the crimping piece 43 can be shortened, which allows the yield to be improved. Furthermore, the right end face 31A of the weld portion 31 is flush with the right end face 45A of the auxiliary piece 45. Thus, at least the end faces on the right side are aligned with each other, and this leads to further improvement in the yield.

Next, as shown in FIG. 7, the terminal 30 is subjected to bending. The terminal 30 is bent into a U-shape having different right and left lengths with the crimping piece 43 and the auxiliary piece 45 rising obliquely upward from the bottom plate portion 41. Thereafter, the electric wire 20 is placed on the terminal 30. In the state where the core wire 21 of the electric wire 20 extends in the front-rear direction, the exposed core wire 21 is disposed on the right half of the weld portion 31, and an end of the insulating coating 23 of the electric wire 20 is disposed on the crimping portion 40. Then, the core wire 21 is ultrasonic-welded to the weld portion 31. At this time, the electric wire 20 is positioned within the bottom plate portion 41 by the crimping piece 43 and the auxiliary piece 45. Thus, the ultrasonic welding can be performed easily without the core wire 21 moving.

Thereafter, the crimping portion 40 is crimped so as to be wound around the outer periphery of the electric wire 20. At this time, the crimping portion 40 is crimped in such a manner that the auxiliary piece 45 extends along the outer shape of the electric wire 20, whereas the leading edge 43A of the crimping piece 43 passes over the first virtual plane P1 to be located below the second virtual plane P2 (on the bottom plate portion 41 side) and is in proximity to the side edge of the bottom plate portion 41 on a side (right side) opposite to the side on which the crimping piece 43 is provided. That is, the leading edge 43A of the crimping piece 43 extends in a direction different from a direction (vertical direction) orthogonal to the weld portion 31, and is in proximity to the side edge of the bottom plate portion 41 on the side (right side) opposite to the side on which the crimping piece 43 is provided. Then, the crimping piece 43 is crimped in such a manner that the end portion of the crimping piece 43 overlaps the end portion of the auxiliary piece 45 at a position below the second virtual plane P2. As described above, the crimping portion 40 is crimped so as to have the overlapping portion below the second virtual plane P2 where a slight gap is formed between the crimping portion 40 and the electric wire 20, rather than above the second virtual plane P2 where the crimping portion 40 is in close contact with the insulating coating 23 in order to ensure the holding force. Accordingly, the insulating coating 23 of the electric wire 20 is less likely to be damaged. Furthermore, since the crimping portion 40 covers the outer periphery of the electric wire 20, a holding force to the electric wire 20 can be ensured sufficiently even with the crimping piece 43 with a cantilever structure.

As described above, in the terminal-equipped electric wire 10 of the first embodiment, the auxiliary piece 45 is shorter than the crimping piece 43. Thus, as compared with the case where a crimping piece extends evenly from both side edges of a bottom plate portion as in the prior art, the dimension in the width direction in the non-crimped state (non-crimped length) can be shortened, which allows the yield to be improved.

Furthermore, in the present embodiment, the outer periphery of the insulating coating 23 is wrapped to the extent that the leading edge of the crimping piece 43 is located on the bottom plate portion 41 side with respect to the first virtual plane P1, which passes through the center of the electric wire 20 and is perpendicular to the bottom plate portion 41, and the leading edge of the crimping piece 43 is in proximity to the side edge of the bottom plate portion 41 on the opposite side. That is, the bottom plate portion 41 and the crimping piece 43 are wound around at least half of the outer periphery of the electric wire 20, and therefore a holding force to the electric wire 20 can be ensured. In particular, when the electric wire 20 is subjected to a force of pulling away the electric wire 20 in a direction perpendicular to the plate face of the weld portion 31, the electric wire 20 is held down by the crimping piece 43 from a direction perpendicular to the bottom plate portion 41. Thus, when the core wire 21 is welded (by ultrasonic welding) to the weld portion 31, the core wire 21 is prevented from being separated from the weld portion 31.

Moreover, in the present embodiment, the outer periphery of the insulating coating 23 is wrapped to the extent that the leading edge of the crimping piece 43 is located on the bottom plate portion 41 side with respect to the second virtual plane P2, which passes through the center of the electric wire 20 and is parallel to the bottom plate portion 41, and the leading edge of the crimping piece 43 is in proximity to the side edge of the bottom plate portion 41 on the opposite side. That is, the bottom plate portion 41 and the crimping piece 43 are wound around at least three quarters of the outer periphery of the electric wire 20, and therefore a holding force to the electric wire 20 can be ensured even more reliably.

Moreover, since the end portion of the crimping piece 43 overlaps the end portion of the auxiliary piece 45, a holding force to the electric wire 20 can be ensured sufficiently.

Moreover, since the right end face 31A of the weld portion 31 and the right end face 45A of the auxiliary piece 45 are flush with each other in the flat, non-crimped state, it is possible to further improve the yield.

Moreover, since the crimping piece 43 and the auxiliary piece 45 extend from both sides of the bottom plate portion 41, positioning of the electric wire 20 can be achieved at the time of placing the electric wire 20 on the bottom plate portion 41.

Second Embodiment

Next, the second embodiment will be described with reference to FIGS. 8 to 13.

With a terminal-equipped electric wire 110 of the second embodiment, the shape of a crimping portion 140 is different from that of the first embodiment. Members and portions having the same functions as those in the first embodiment are given the same reference numerals, and the descriptions thereof are omitted or simplified. Vertical, left-right, and front-rear directions in the present embodiment are the same as those in the first embodiment.

Figure 8:
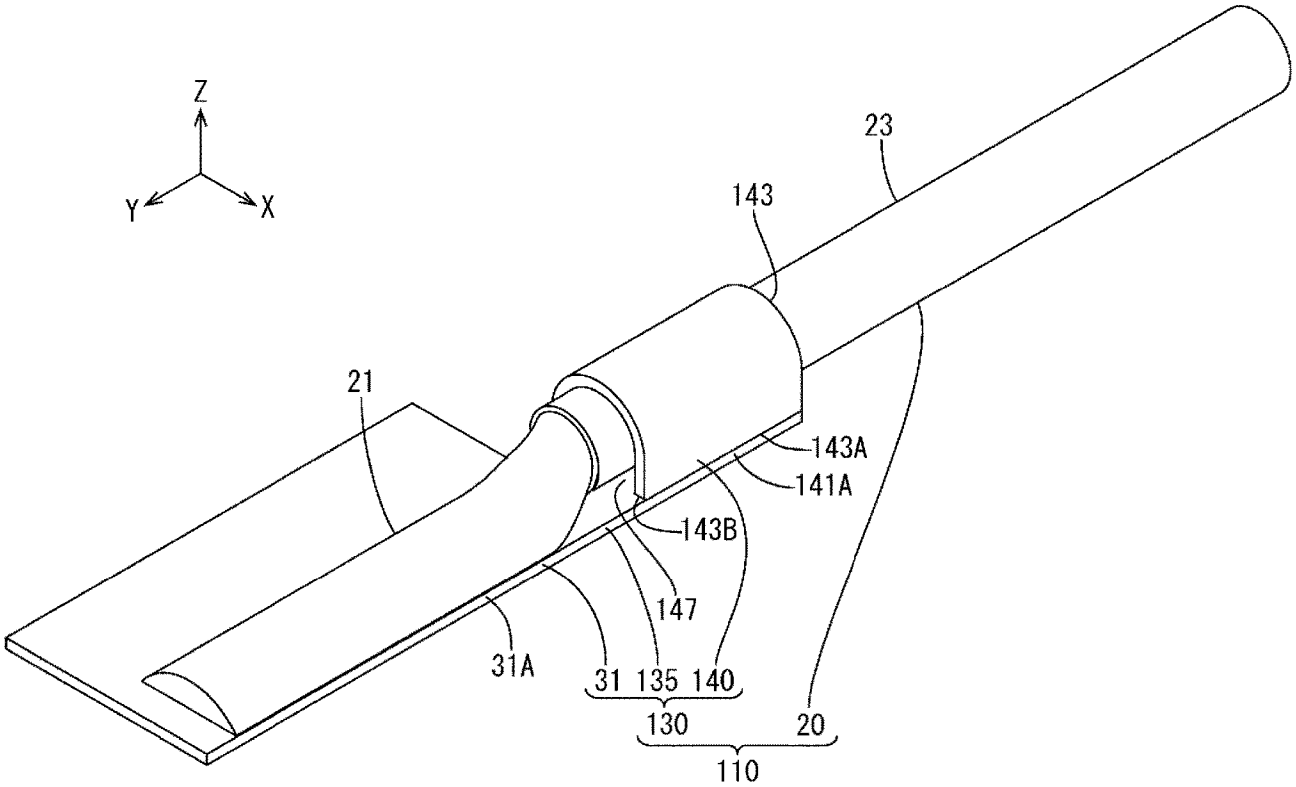
FIG. 8 is a perspective view of a terminal-equipped electric wire according to a second embodiment.
Figure 9:
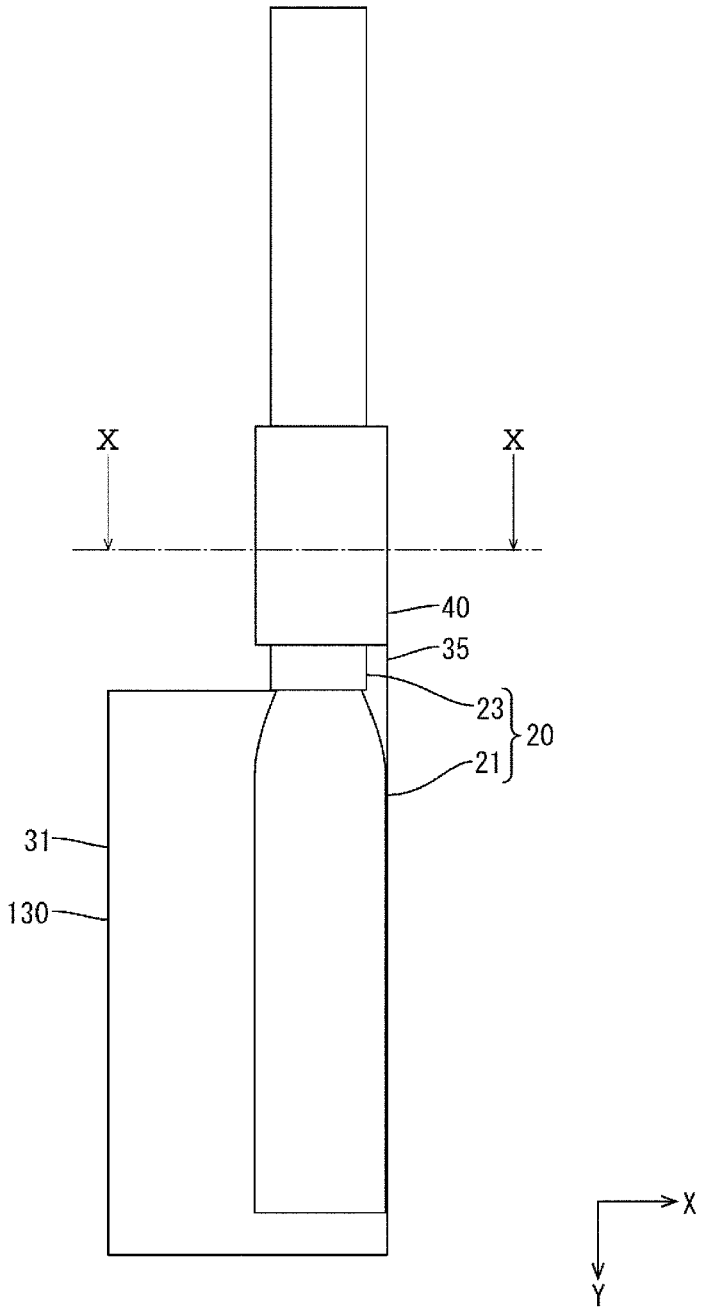
FIG. 9 is a plan view of the terminal-equipped electric wire.

The terminal-equipped electric wire 110 includes an electric wire 20 and a terminal 130. The terminal 130 is formed by pressing and then bending an electrically conductive metal plate material. As shown in FIG. 8, the terminal 130 includes a weld portion 31 to which the core wire 21 of the electric wire 20 is to be welded, a crimping portion 140 to be crimped to the electric wire 20, and a neck portion 135 connecting the weld portion 31 and the crimping portion 140.

As shown in FIG. 8, the neck portion 135 is formed so as to extend rearward from the rear end of the weld portion 31. The right end position of the neck portion 135 is flush with a right end face 31A of the weld portion 31, and also is flush with a right end face 141A of a bottom plate portion 141 of the crimping portion 140. The dimension of the neck portion 135 in the width direction is substantially the same as or slightly smaller than the maximum outer diameter of the electric wire 20. The position of the electric wire 20 is determined by the position of the neck portion 135 and the position of the crimping portion 140 continuous therewith, and the core wire 21 of the electric wire 20 is welded to a right end portion of the weld portion 31.

Figure 10:
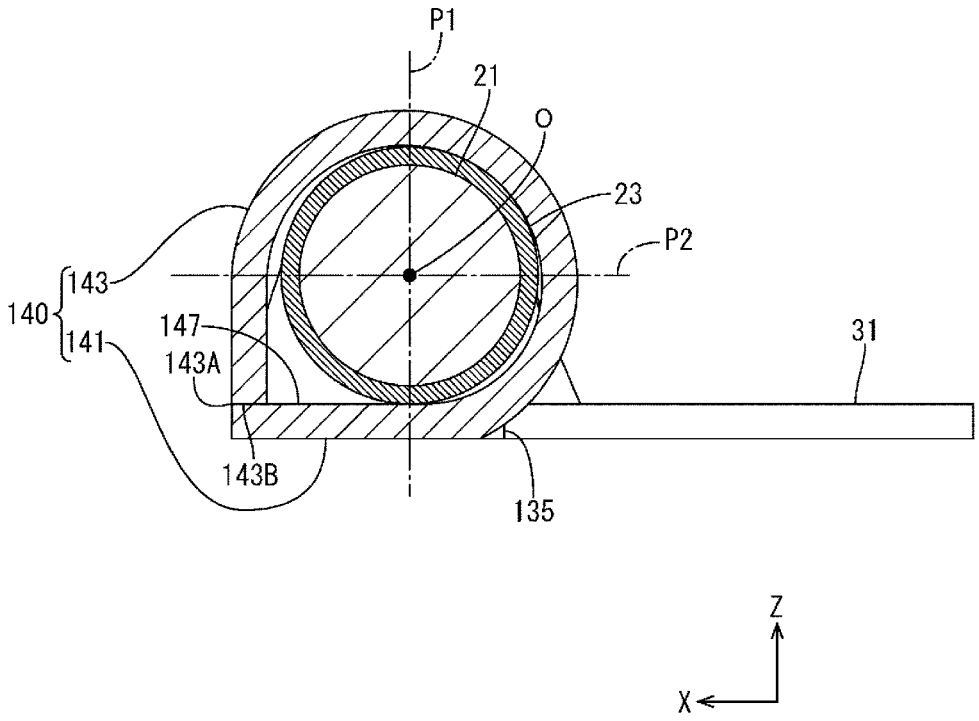
FIG. 10 is a sectional view taken along X-X of FIG. 9.
Figure 11:
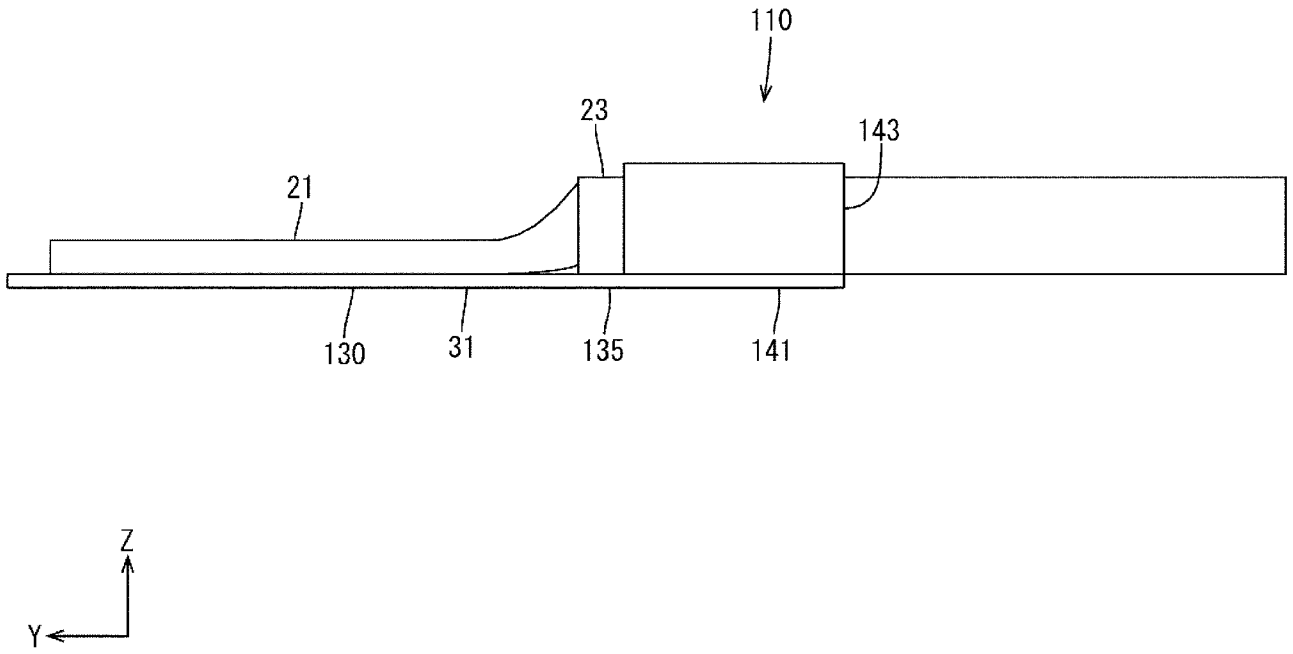
FIG. 11 is a right side view of the terminal-equipped electric wire.
Figure 12:
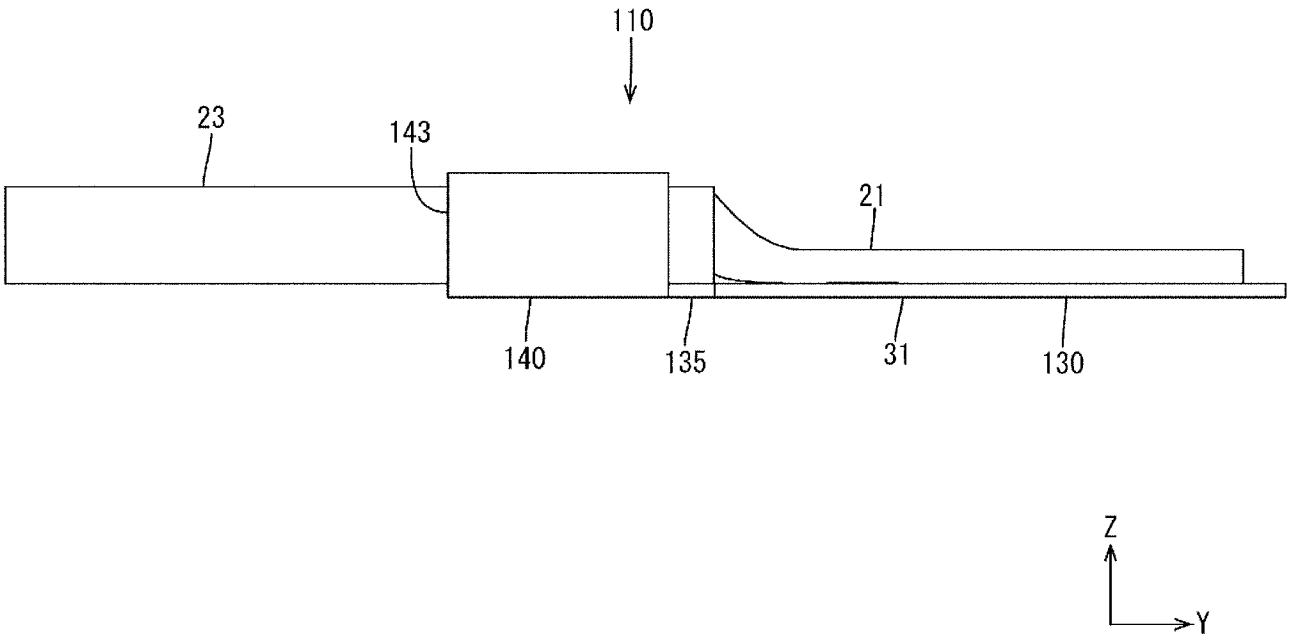
FIG. 12 is a left side view of the terminal-equipped electric wire.

As shown in FIGS. 8 and 10, the crimping portion 140 includes the bottom plate portion 141 and a crimping piece 143. The bottom plate portion 141 is continuous with the weld portion 31 via the neck portion 135, and an insulating coating 23 of the electric wire 20 is placed on the bottom plate portion 141. A left end portion of the bottom plate portion 141 is continuous with the crimping piece 143, while an upper surface of a right end portion thereof is an abutted surface147 against which an abutting surface143B of the crimping piece 143 is to abut.

As shown in FIGS. 8 and 10, the crimping piece 143 is provided so as to extend from one side edge (left side edge) of the bottom plate portion 141 in a direction intersecting with the direction in which the electric wire 20 extends (the front-rear direction). Specifically, the crimping piece 143 is crimped so as to be wound around the outer periphery of the insulating coating 23 of the electric wire 20. The width of the crimping piece 143 is such that after the crimping piece 143 is wound around the outer periphery of the electric wire 20, the abutting surface143B abuts against the abutted surface147 of the bottom plate portion 141. Furthermore, as shown in FIG. 13, the left end of the crimping piece 143 before being subjected to bending (non-crimped state) is at the same position as the left end of the weld portion 31.

As shown in FIG. 10, the state where the crimping portion 140 is wound around the outer periphery of the electric wire 20 will be described. In the state where the crimping portion 140 is wound around the outer periphery of the electric wire 20, a leading edge 143A of the crimping piece 143 passes over a first virtual plane P1 to be located below a second virtual plane P2 (on the bottom plate portion 141 side), and the abutting surface143B of the crimping piece 143 abuts against the abutted surface147, which is an upper surface of a side edge portion of the bottom plate portion 141 on a side (right side) opposite to a side on which the crimping piece 143 is provided. That is, the leading edge 143A of the crimping piece 143 extends in a direction different from a direction (vertical direction) orthogonal to the weld portion 31 and abuts against the abutted surface 147 of the bottom plate portion 141 in proximity to the side edge of the bottom plate portion 141 on the side (right side) opposite to the side on which the crimping piece 143 is provided.

The configurations of the terminal-equipped electric wire 110 and the terminal 130 of the present embodiment are as described above. Subsequently, methods of assembling the terminal-equipped electric wire 110 and the terminal 130 and functions of the terminal-equipped electric wire 110 and the terminal 130 will be described.

Figure 13:
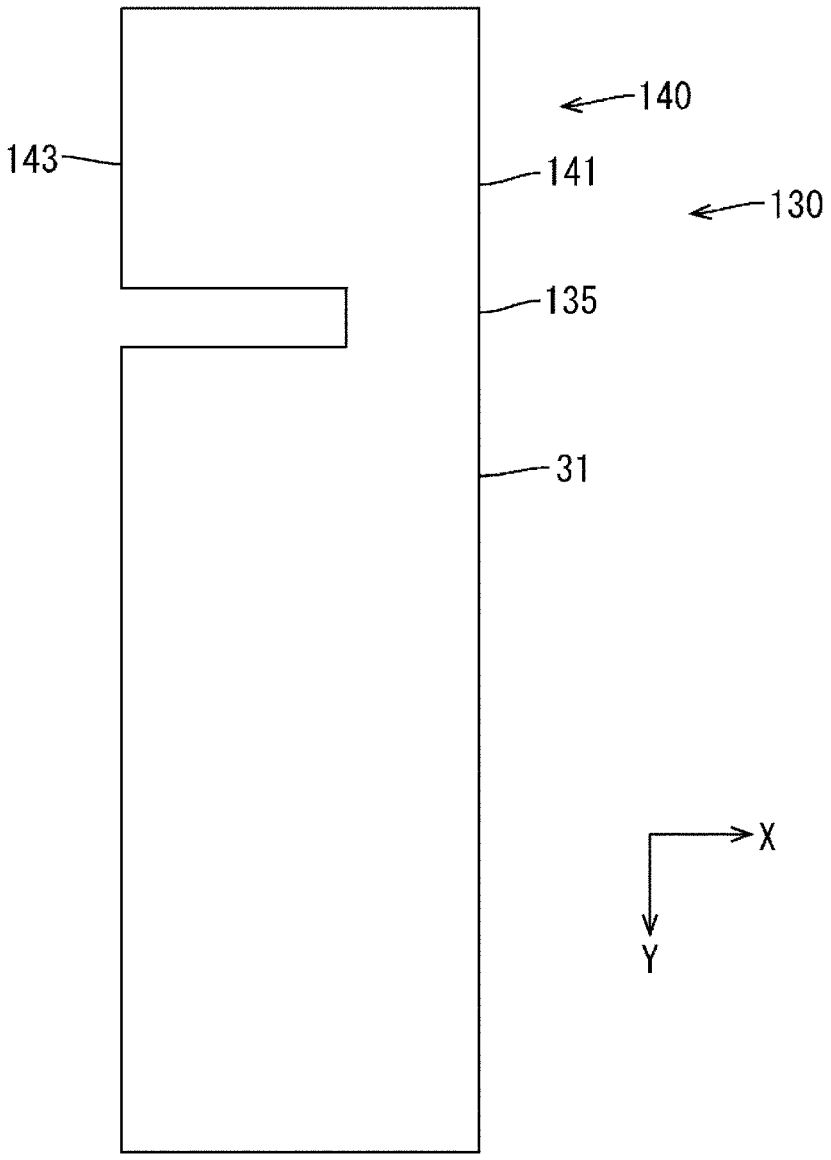
FIG. 13 is a plan view showing a non-crimped state of the terminal.

An electrically conductive metal plate material is subjected to pressing to punch out the terminal 130 as shown in FIG. 13. At this time, the leading edge 43A (left end position) of the crimping piece 143 is at the same position as the left end of the weld portion 31. Thus, the non-crimped length (the dimension in the width direction) of the crimping piece 143 can be shortened, which allows the yield to be improved. Furthermore, the right end face 31A of the weld portion 31 is flush with the right end face of the neck portion 135 and with the right end face 141A of the bottom plate portion. Thus, at least the end faces on the right side are aligned with each other, and this leads to further improvement in the yield.

Next, the terminal 130 is subjected to bending. The terminal 130 is bent such that the crimping piece 143 rises obliquely to the upper left from the bottom plate portion 141. Then, the electric wire 20 is placed on the terminal 130. In the state where the core wire 21 of the electric wire 20 extends in the front-rear direction, the exposed core wire 21 is disposed on a right end portion of the weld portion 31, and the terminal end of the insulating coating 23 of the electric wire 20 is disposed on the bottom plate portion 141 of the crimping portion 140. Then, the core wire 21 is ultrasonic-welded to the weld portion 31.

Thereafter, the crimping portion 140 is crimped so as to be wound around the outer periphery of the electric wire 20. The crimping portion 140 is crimped in such a manner that the leading edge 143A of the crimping piece 143 passes over the first virtual plane P1 to be located below the second virtual plane P2 (on the bottom plate portion 141 side) and the abutting surface 143B of the crimping piece 143 abuts against the abutted surface 147, which is the upper surface of the side edge portion of the bottom plate portion 141 on the side (right side) opposite to the side on which the crimping piece 143 is provided. As described above, the end face (abutting surface 143B) of the crimped crimping piece 143 abuts against the abutted surface 147, and therefore the insulating coating 23 of the electric wire 20 is less likely to be damaged by the corners of the end face and the like. Furthermore, since the crimping portion 140 covers the outer periphery of the electric wire 20, a holding force to the electric wire 20 can be ensured sufficiently even with the crimping piece 143 with a cantilever structure.

As described above, in the terminal-equipped electric wire 10 of the present embodiment, only the crimping piece 143 extends from the bottom plate portion 141. Thus, the dimension in the width direction in the non-crimped state (non-crimped length) can be shortened, which allows the yield to be improved.

Moreover, the right end face 31A of the weld portion 31 is flush with the right end face 141A of the bottom plate portion 141 in the flat, non-crimped state, and the non-crimped length of the crimping portion 140 falls within the width of the weld portion 31. Thus, it is possible to further improve the yield.

On the other hand, since the end face (abutting surface143B) of the crimping piece 143 abuts against the abutted surface147 of the bottom plate portion 141, a holding force to the electric wire 20 can be ensured sufficiently.

Other Embodiments

The techniques disclosed herein are by no means limited to the embodiments described above with reference to the drawings. For example, various modes to be described below are also encompassed therein.

(1) Although the leading edges 43A, 143A of the crimping pieces 43, 143 are located below the second virtual plane P2 in the first and second embodiments, they need not extend up to the second virtual plane P2 as long as they pass over the first virtual plane P1.

(2) Although the crimping portions 40, 140 in the first and second embodiments are configured such that the crimping pieces 43, 143 are wound around so as to cover the entire outer periphery of the electric wire 20, a gap may be present between the crimping pieces 43, 143 and the auxiliary piece 45 or the bottom plate portion 141.

(3) Although the right end face 31A of the weld portion 31 is flush with the right end face 45A of the auxiliary piece 45 or with the right end face 141A of the bottom plate portion 141 in the flat, non-crimped state in the first and second embodiments, they need not be flush with each other.

(4) Although ultrasonic welding is used to weld the core wire 21 to the weld portion 31 in the first and second embodiments, other methods such as resistance welding may be used to weld the core wire 21.

(5) Although the neck portions 35, 135 are provided in the first and second embodiments, the bottom plate portions 41, 141 of the crimping portions 40, 140 may be directly continuous with the weld portion 31 without the neck portion.

DESCRIPTION OF SYMBOLS 10, 110 Terminal-equipped electric wire
20 Electric wire
21 Core wire
23 Insulating coating
30, 130 Terminal
31 Weld portion
31A Right end face
35, 135 Neck portion
40, 140 Crimping portion
41, 141 Bottom plate portion
141A Right end face
43, 143 Crimping piece
43A, 143A Leading edge
143B Abutting surface
45 Auxiliary piece
45A Right end face
147 Abutted surface
O Center in radial direction of electric wire
P1 First virtual plane
P2 Second virtual plane

What is claimed is:

1. A terminal-equipped electric wire including an electric wire with a core wire whose outer periphery is surrounded by an insulating coating, a terminal being connected to the core wire exposed from an end portion of the electric wire, the terminal comprising;

a flat-plate-shaped weld portion to which the core wire is welded;

a bottom plate portion that is continuous with the weld portion and on which the insulating coating of the electric wire is placed;

a crimping piece extending from one side edge of the bottom plate portion in a direction intersecting with a direction in which the electric wire placed on the bottom plate portion extends; and an auxiliary piece that extends in a direction intersecting with the direction in which the electric wire placed on the bottom plate portion extends and is shorter than the crimping piece is provided on the side edge of the bottom plate portion on the side opposite to the side on which the crimping piece is provided, wherein, in a state where the crimping piece is crimped so as to be wound around an outer periphery of the insulating coating of the electric wire, a leading edge of the crimping piece is located on a bottom plate portion side with respect to a first virtual plane that passes through a center of the electric wire and is perpendicular to the bottom plate portion, and the leading edge of the crimping piece is in proximity to a side edge of the bottom plate portion on a side opposite to a side on which the crimping piece is provided, and in a state where the electric wire is crimped by the crimping piece, an end portion of the crimping piece and an end portion of the auxiliary piece overlap each other.

2. The terminal-equipped electric wire according to claim 1, wherein in the state where the crimping piece is crimped so as to be wound around the outer periphery of the insulating coating of the electric wire, the leading edge of the crimping piece is located on the bottom plate portion side with respect to a second virtual plane that passes through the center of the electric wire and is parallel to the bottom plate portion, and the leading edge of the crimping piece is in proximity to the side edge of the bottom plate portion on the side opposite to the side on which the crimping piece is provided.

3. The terminal-equipped electric wire according to claim 1, wherein in a state where the electric wire is crimped by the crimping piece, an end face of the crimping piece abuts against the bottom plate portion.

4. The terminal-equipped electric wire according to claim 1, wherein an end face of the weld portion and an end face of the bottom plate portion are flush with each other in a flat, non-crimped state.

5. The terminal-equipped electric wire according to claim 1, wherein an end face of the weld portion and an end face of the auxiliary piece are flush with each other in a flat, non-crimped state.

6. A terminal comprising:

a flat-plate-shaped weld portion to which a core wire of an electric wire is to be welded;

a bottom plate portion that is continuous with the weld portion and on which a portion surrounded by an insulating coating in the electric wire is to be placed;

a crimping piece extending from one side edge of the bottom plate portion in a direction intersecting with a direction in which the electric wire placed on the bottom plate portion extends; and an auxiliary piece that extends in a direction intersecting with the direction in which the electric wire placed on the bottom plate portion extends and is shorter than the crimping piece is provided on the side edge of the bottom plate portion on the side opposite to the side on which the crimping piece is provided, wherein, in a state where the crimping piece is crimped so as to be wound around an outer periphery of the electric wire, a leading edge of the crimping piece extends in a direction different from the direction orthogonal to the weld portion, and is in proximity to a side edge of the bottom plate portion on a side opposite to a side on which the crimping piece is provided, and in a state where the electric wire is crimped by the crimping piece, an end portion of the crimping piece and an end portion of the auxiliary piece overlap each other.

7. The terminal according to claim 6, wherein in a state where the electric wire is crimped by the crimping piece, an end face of the crimping piece abuts against the bottom plate portion.

8. The terminal according to claim 6, wherein an end face of the weld portion and an end face of the bottom plate portion are flush with each other in a flat, non-crimped state.

9. The terminal according to claim 6, wherein an end face of the weld portion and an end face of the auxiliary piece are flush with each other in a flat, non-crimped state.

* * * * *